US007348503B2

(12) United States Patent
Shiroyama et al.

(10) Patent No.: US 7,348,503 B2
(45) Date of Patent: Mar. 25, 2008

(54) DIAL TYPE SWITCH MECHANISM

(75) Inventors: Katsunari Shiroyama, Aichi-ken (JP); Tadao Suzuki, Aichi-ken (JP); Yasuo Katayama, Aichi-ken (JP); Yasuhiro Irie, Osaka (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 11/587,276

(22) PCT Filed: Apr. 27, 2005

(86) PCT No.: PCT/JP2005/007975

§ 371 (c)(1),
(2), (4) Date: Oct. 23, 2006

(87) PCT Pub. No.: WO2005/112061

PCT Pub. Date: Nov. 24, 2005

(65) Prior Publication Data

US 2007/0256912 A1 Nov. 8, 2007

(30) Foreign Application Priority Data

Apr. 28, 2004 (JP) ..... 2004-133485

(51) Int. Cl.
*H01H 19/00* (2006.01)

(52) U.S. Cl. ..... 200/4; 200/14; 345/184

(58) Field of Classification Search ..... 200/4, 200/5 R, 11 R, 14, 17 R, 18, 336; 345/184
See application file for complete search history.

(56) References Cited

U.S. PATENT DOCUMENTS 4,857,677 A 8/1989 Tanaka et al.
5,665,946 A * 9/1997 Nishijima et al. ..... 200/4
6,262,378 B1 * 7/2001 Chou ..... 200/4

(Continued)

FOREIGN PATENT DOCUMENTS

JP 2668212 B2 7/1997

(Continued)

OTHER PUBLICATIONS

International Search Report of PCT/JP2005/007975 date of mailing Jun. 14, 2005.

*Primary Examiner*—Michael A Friedhofer
(74) *Attorney, Agent, or Firm*—Westerman, Hattori, Daniels & Adrian, LLP.

(57) ABSTRACT

A dial type switch mechanism is developed in which an installation space can be made as small as possible. In a dial type switch mechanism (10) furnished with a push type switch part provided in its center, and a dial switch part which operates a dial fitted around the push type switch part, there are provided: a substantially cylindrical dial knob (21), in the center of which a cavity is provided for the push type switch part to be installed; a ring-shaped joint ring (23), which is supported such that it can rotate freely relative to a front panel (6) and connects and rotates together with the dial knob (21); and a rotary bracket (24), which is joined to the joint ring (23), and in which a switch rotation shaft (24*b*) that operates the dial type switch part is connected together with a ring-shaped member (24*a*) via an arm (24*c*).

7 Claims, 7 Drawing Sheets

U.S. PATENT DOCUMENTS

| | | | | |
|---|---|---|---|---|
| 6,329,898 | B1 * | 12/2001 | Mizobuchi | 338/162 |
| 6,420,667 | B1 * | 7/2002 | Miwa et al. | 200/4 |
| 6,610,937 | B2 * | 8/2003 | Yamaguchi | 200/4 |
| 6,621,016 | B2 * | 9/2003 | Ohba et al. | 200/4 |
| 6,667,446 | B1 * | 12/2003 | Schuberth et al. | 200/4 |
| 6,670,567 | B1 * | 12/2003 | Koseki et al. | 200/564 |
| 6,867,379 | B2 * | 3/2005 | Hayashi | 200/4 |
| 7,238,904 | B2 * | 7/2007 | Ogawa et al. | 200/336 |
| 2002/0023826 | A1 | 2/2002 | Miwa et al. | |

FOREIGN PATENT DOCUMENTS

| | | | |
|---|---|---|---|
| JP | 2001-184966 | A | 7/2001 |
| JP | 2001-184969 | A | 7/2001 |
| JP | 2001-189117 | A | 7/2001 |
| JP | 2001-229780 | A | 8/2001 |
| JP | 2001-236861 | A | 8/2001 |
| JP | 2002-63835 | A | 2/2002 |
| JP | 2004/185927 | A | 7/2004 |

* cited by examiner

DIAL TYPE SWITCH MECHANISM

TECHNICAL FIELD

The present invention relates to a dial type switch mechanism, which is provided with a dial installed around an operating surface side of a push switch, and that performs switching operations of a dial type switch by the dial being rotated.

BACKGROUND ART

In a vehicle air conditioner, for example, an air conditioning control panel is installed in the front panel or the like at a driver's seat in order to perform a range of operations such as turning the device on and off, selecting the operating mode, setting the temperature, and the like. Switches required for the above-mentioned range of operations are installed in such an air conditioning control panel, and among the switches used herein there is a type called a "dial type switch mechanism."

In this dial type switch mechanism, a pressure operating surface of a push type switch part, which performs switching operations by pressure being applied to the switch part, is installed in the center of the front face. Furthermore, a control dial of the dial switch part, which performs switching operations by rotary operation, is integrated with the push type switch part around its circumference.

In the above-mentioned conventional dial type switch mechanism, the construction is such that the turning force of the switching operation, which is obtained by operating the control dial of the dial switch part, is transmitted by the engagement of gears, operating a switch body installed on the same axis as the gears. That is, since the control dial, the gears and the switch body of the dial type switch part are located such that they are adjacent from a plane view, when installing a dial type switch mechanism in a front panel, it is necessary to make space available for installing the gears around the control dial. (For example, refer to Patent Document 1)

Patent Document 1: Japanese Unexamined Patent Application, First Publication No. 2001-229780 (refer to FIG. 3)

Patent Document 2: Japanese Unexamined Patent Application, First Publication No. 2001-236861

Patent Document 3: Japanese Unexamined Patent Application, First Publication No. 2001-189117

DISCLOSURE OF INVENTION

As described above, because a conventional dial type switch mechanism uses gears, then in addition to the increase in the number of parts, the structure requires a large installation space in terms of surface area. Therefore, in the case where the installation space is limited, such as the front panel of a vehicle for example, it is difficult to ensure sufficient installation space for the switch mechanism itself. Therefore, there is a problem in that the degree of freedom in the design of an air conditioner control panel or the like is reduced.

Furthermore, from the viewpoint of operability of the switch section, since it is preferable to have one with an appropriately sized switching operation section (control dial and pressure operating surface), it is desirable that the switching operation section is an appropriate size even where the installation space is limited.

In this manner, the degree of freedom in the design of an air conditioner control panel in which the above-mentioned conventional dial type switch mechanism is used is reduced, and especially in the case where the installation space is limited, it is difficult to produce a design that is consistent with the location (space reserved) and operability (size of the operation part.

The present invention has been made in view of the above circumstances, and therefore has objects to develop a dial type switch mechanism in which the installation space can be made as small as possible, and to increase the degree of freedom in the design of an air conditioner control panel or the like which uses this switch mechanism.

The present invention uses the following method in order to solve the above problems.

A dial type switch mechanism according to the present invention is a dial type switch mechanism furnished with at least one push type switch part provided in its center, and a dial switch part which operates a dial fitted around said push type switch part, wherein there are provided:

a substantially cylindrical rotary operating member, in the center of which a cavity is provided for said push type switch part to be installed; a ring-shaped connecting member, which is supported such that it can rotate freely relative to an operating surface substrate, and connects and rotates together with said rotary operating member; and a rotary bracket member, which is joined to said connecting member, and in which a switch rotation shaft that operates said dial type switch part is connected together with a ring-shaped member via a turning force transmission member.

Using such a dial type switch mechanism, the rotary movement of the rotary operating member by the switching operation is transmitted to the rotary bracket member via the connecting member, due to comprising: a substantially cylindrical rotary operating member in the center of which a cavity is provided for the push type switch part to be installed; a ring-shaped connecting member, which is supported such that it can rotate freely relative to the operating surface substrate, and connects and rotates together with the rotary operating member; and a rotary bracket member, which is connected to the connecting member, and in which a switch rotation shaft that operates the dial type switch part is joined together with the ring-shaped member via a turning force transmission member. Therefore, the substantially cylindrical rotary operating member, the ring-shaped connecting member, and the ring-shaped member of the rotary bracket member, are located concentrically with the switch rotation shaft in the center. When the dial type switch is operated, it becomes a dial switch mechanism with a structure in which the members are connected directly in the axial direction and rotate together.

In the above-mentioned dial type switch mechanism, regarding the connection of the connecting member and the rotary bracket member, it is preferable that a turning force is transmitted by the engagement of a convex part provided in the connecting member and a concave part provided in the rotary bracket member. Such a construction enables the connecting member and the rotary bracket member to control the positions of the two members in the rotation direction reliably, and to transmit the rotational movement reliably.

In the above-mentioned dial type switch mechanism, regarding the engagement of the convex part and the concave part, it is preferable that a mating location adjustment is provided in the radial direction. Using such a construction, even if the centers of the convex part and the concave part have a slight offset between them, the mating location adjustment absorbs it, thus enabling them to be mated together.

In the above-mentioned dial type switch mechanism, it is preferable that a sliding part of the push type switch is installed in a ring-shaped support member having a substantially U shaped retaining part, which is fixed to and supported by a switch mechanism body substrate, and is retained in a guide part which supports parallel end faces provided in the sliding part such that they can slide freely. Using such a construction, if the push switch part of the push type switch is pressed, the parallel end faces of the sliding part are guided by the guide part, so that it is possible for them to slide smoothly without shaking. Furthermore, in the push type switch, it is possible to locate both the sliding part and the guide part centrally on the sliding axis over the length of the parallel end faces and the guide part. It is preferable to support the parallel end faces by the guide part in at least four places, being the, top, bottom, right and left.

In the above-mentioned dial type switch mechanism, it is preferable that a sliding surface part which supports the parallel end faces by the guide part is provided with a guide-rail mechanism in which the convex part and the concave groove part are engaged. Such a construction enables the push type switch to slide stably without shaking by the operation of pressing the push switch part.

Regarding the guide-rail mechanism of the sliding surface part, the construction may be such that convex parts, which extend in the sliding direction, are provided in at least four places of top, bottom, right and left for support. Such a construction also enables it to slide stably.

In the above-mentioned dial type switch mechanism, it is preferable that a corrugated surface, which varies in the circumference direction, is formed on an end face of an operating surface side of the support member, facing the rotary bracket member, and also that a rotatable spherical member, which is subjected to an urging force from an elastic material in a direction towards the corrugated surface with which it makes contact, is provided in an end face of an operating surface side of the rotary bracket and is supported such that it can move in the direction of the force. In such a construction, when the rotary operating member is operated, the spherical member to which a force is applied moves along in contact with the corrugated surface, so that it is possible to obtain a sense of regulation suitable to the dial type switch.

In the above-mentioned dial type switch mechanism, it is preferable that a shadow prevention part is installed, which reduces or removes a shadow of the turning force transmission member formed on a front surface of the push type switch by a light source. Using such a construction, it is possible to solve the cosmetic issues associated with the unnecessary shadow formed on the operating surface.

In addition, specific examples of the shadow prevention part are as follows.

(1) Use of a transparent or white resin for a turning force transmission member or the like.
(2) Use of a plurality of light sources.
(3) Provision of a light diffusing member (for example, frosted glass).

According to the above-mentioned dial type switch mechanism of the present invention, when switching operations of the dial type switch are performed, the rotation of the rotary operating member is transmitted to the rotary bracket member via the connecting member, so the rotary operating member, the connecting member and the rotary bracket member are located concentrically, with the switch rotation shaft in the center. In other words, since the construction is such that the rotary operating member, the connecting member and the rotary bracket member are located coaxially with the switch rotation shaft, when the rotary switch part is operated, all of the members are connected directly in the axial direction, and rotate together. Therefore, it is possible to reduce the flat surface installation space of the dial type switch mechanism viewed from the operating surface side, and even in the case where the installation space is limited such as the front panel of a vehicle for example, it is easy to find installation space for the switch mechanism. Therefore, a significant effect can be obtained whereby the degree of freedom in the design of an air conditioner control panel or the like is improved.

Furthermore, since the installation space of the dial type switch mechanism is reduced, it is also possible to enlarge the switching operation section (control dial or pressure operating surface) in the limited installation space. Therefore, it is possible to provide a switch mechanism that has excellent operability.

Accordingly, in an air conditioner control panel or the like using the above-mentioned dial type switch mechanism of the present invention, a significant effect can be obtained in that it is possible to produce a design that is consistent with the location (with ensured space) and operability (with an appropriate size of the operation section).

Moreover, since the above-mentioned dial type switch mechanism of the present invention has a construction in which no gears are used, it is also possible to reduce the number of parts.

BEST MODE FOR CARRYING OUT THE INVENTION

Hereunder is a description of a first embodiment of a dial type switch mechanism according to the present invention, based on the drawings.

Figure 4:
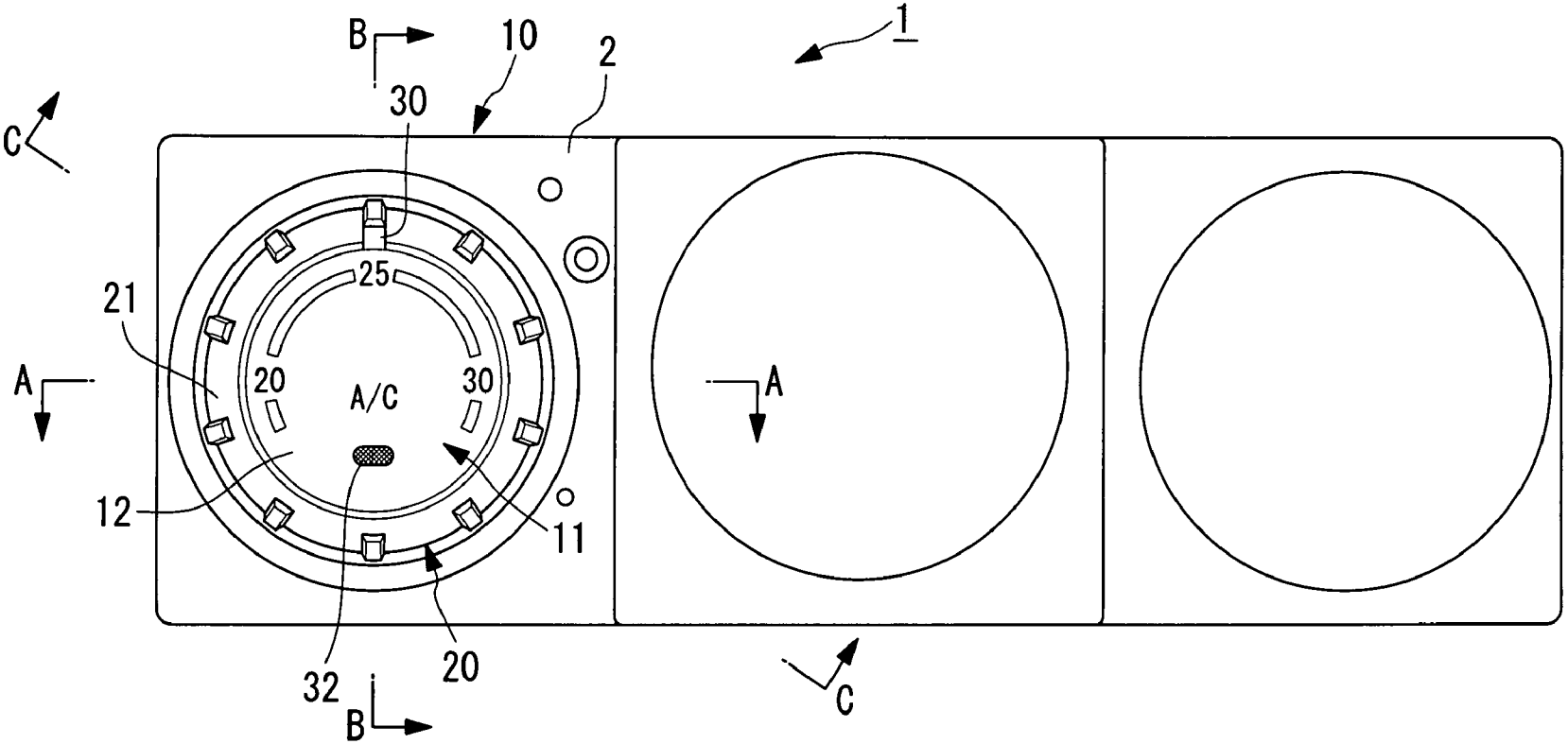
FIG. 4 is a front view showing a structural example of an air conditioner control panel which uses the dial type switch mechanism of the present invention.
Figure 5:
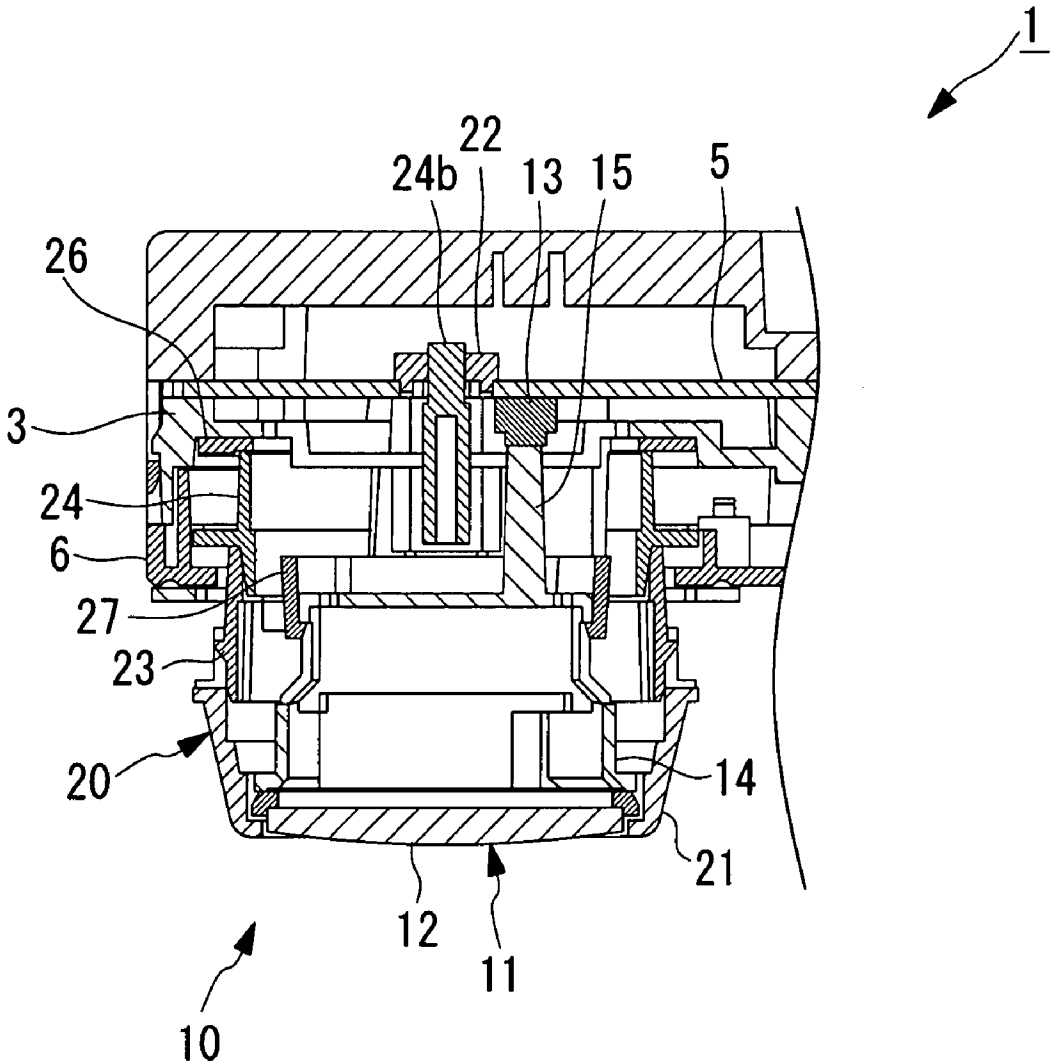
FIG. 5 is a sectional view through A-A of FIG. 4.
Figure 6:
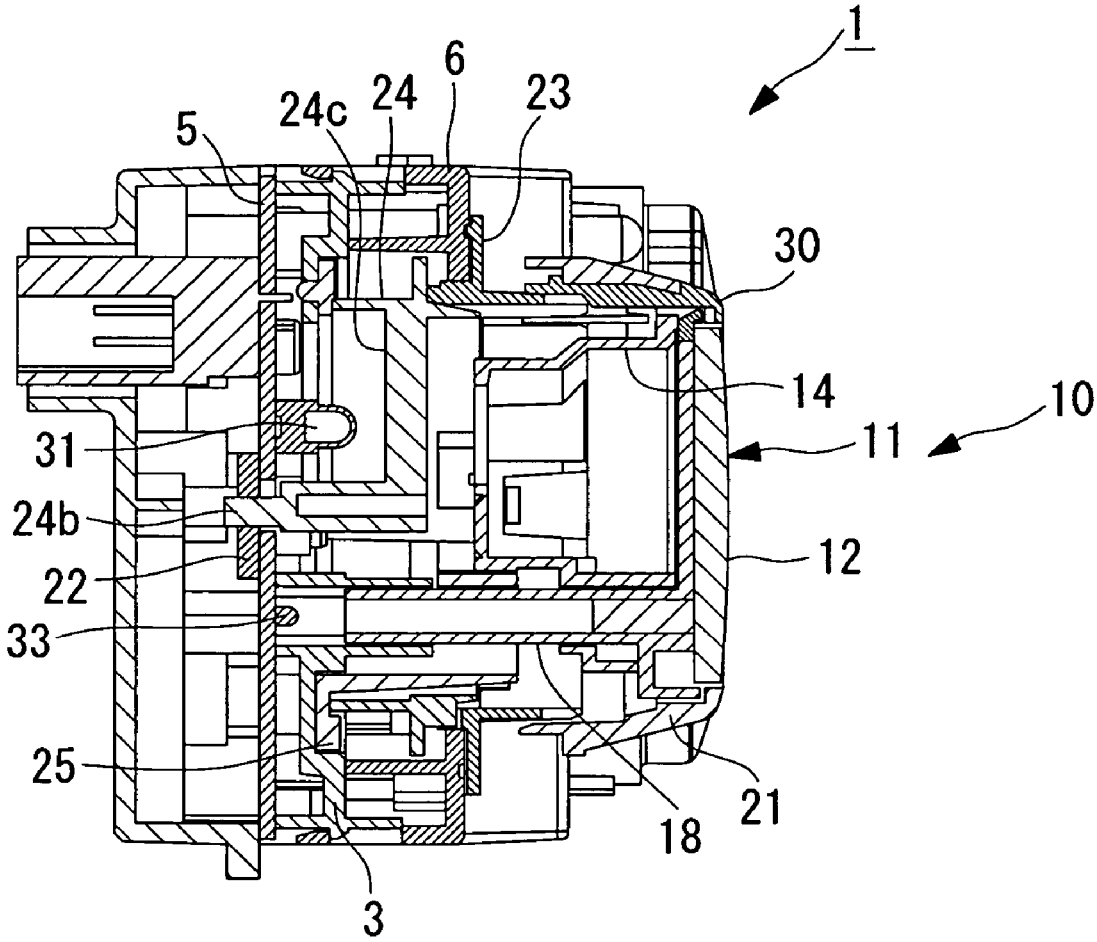
FIG. 6 is a sectional view through B-B of FIG. 4.

FIG. 4 and FIG. 5 show parts of an air conditioner control panel of a vehicle air conditioner (referred to hereunder as "air conditioner") as an example of a control panel in which a dial type switch mechanism is used. Such an air conditioner control panel is installed such that it constitutes part of the front panel provided in front of the driver's seat of a vehicle. An air conditioner control panel 1 as shown in the figure has a range of switches exposed to the operating surface (front face) 2. For example, a dial type switch mechanism 10 comprises a push type switch part 11 which turns the air conditioner on and off, and a dial type switch part 20 which sets the desired temperature.

The construction of the dial type switch mechanism 10 is such that a circular pressure operating surface 12 of the push type switch part 11 is provided in the central part of the operating surface 2, and a substantially cylindrical dial knob 21 of the dial type switch part 20 is installed such that it forms the outer peripheral surface. The dial knob 21 is a rotary operating member of the dial type switch part 20, and it is possible to change the temperature setting by rotating the dial knob 21 right and left.

For the push type switch part 11, in the case where the air conditioner is stopped, the air conditioner is turned on (ON) by pushing the pressure operating surface 12 once, and by pushing the pressure operating surface 12 again from the operating state of the air conditioner, it stops operating, and turns off (OFF).

Figure 1:
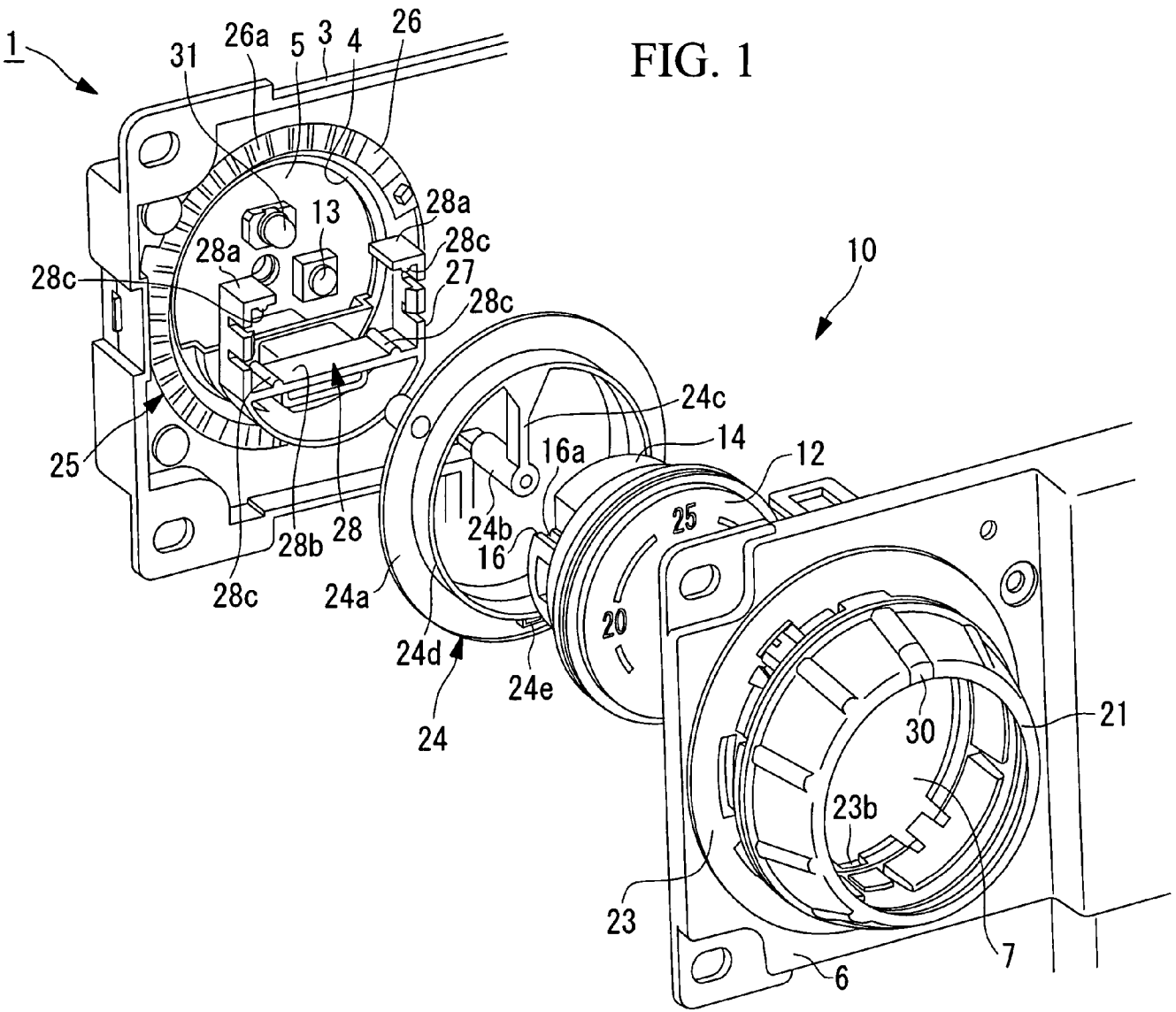
FIG. 1 is an exploded perspective view showing a structural example of a dial type switch mechanism according to the present invention.
Figure 7:
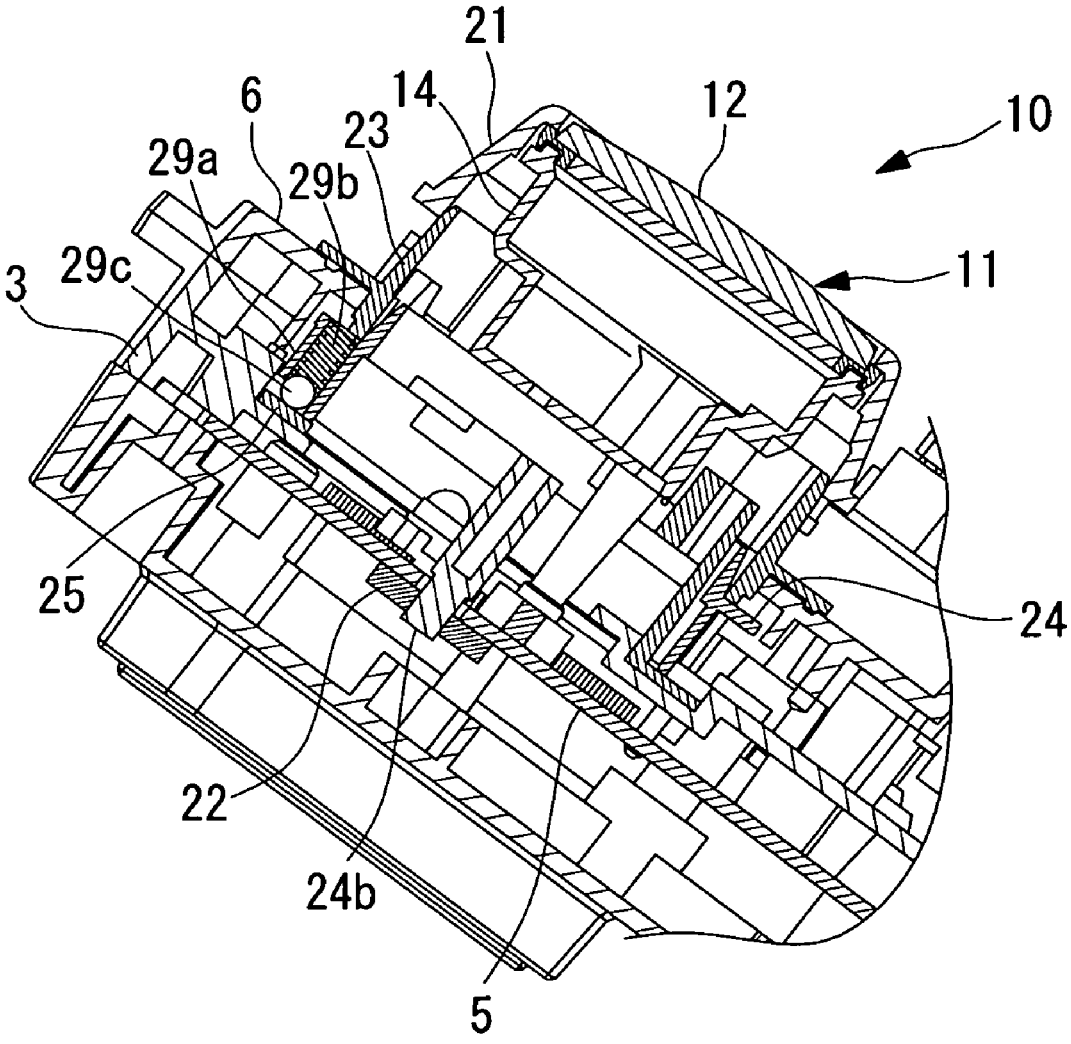
FIG. 7 is a sectional view through C-C of FIG. 4.

Next is a description of the internal structure of the above-mentioned dial type switch mechanism (referred to hereunder as "switch mechanism") 10 based on FIG. 1 through to FIG. 7.

The switch mechanism 10 is fixed to and supported by a chassis 3, being a switch mechanism body substrate. The chassis 3 in this case is a common substrate (base member) for a range of switches and electrical equipment installed in the air conditioner control panel 1, but in the case where the switch mechanism 10 is used on its own, it is a single-purpose substrate.

Figure 2:
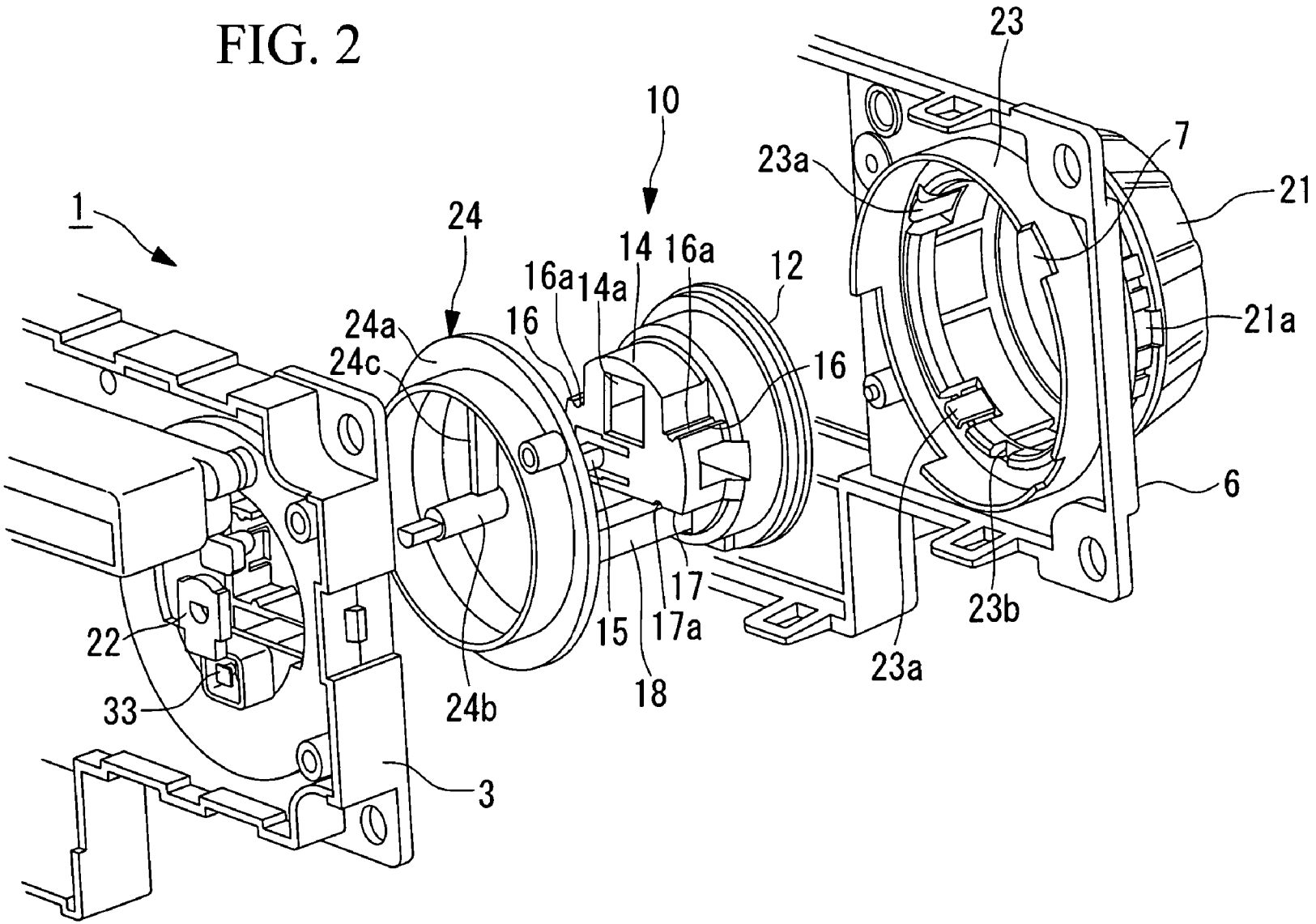
FIG. 2 is an exploded perspective view showing the exploded perspective view of FIG. 1 viewed from the rear surface side.
Figure 3:
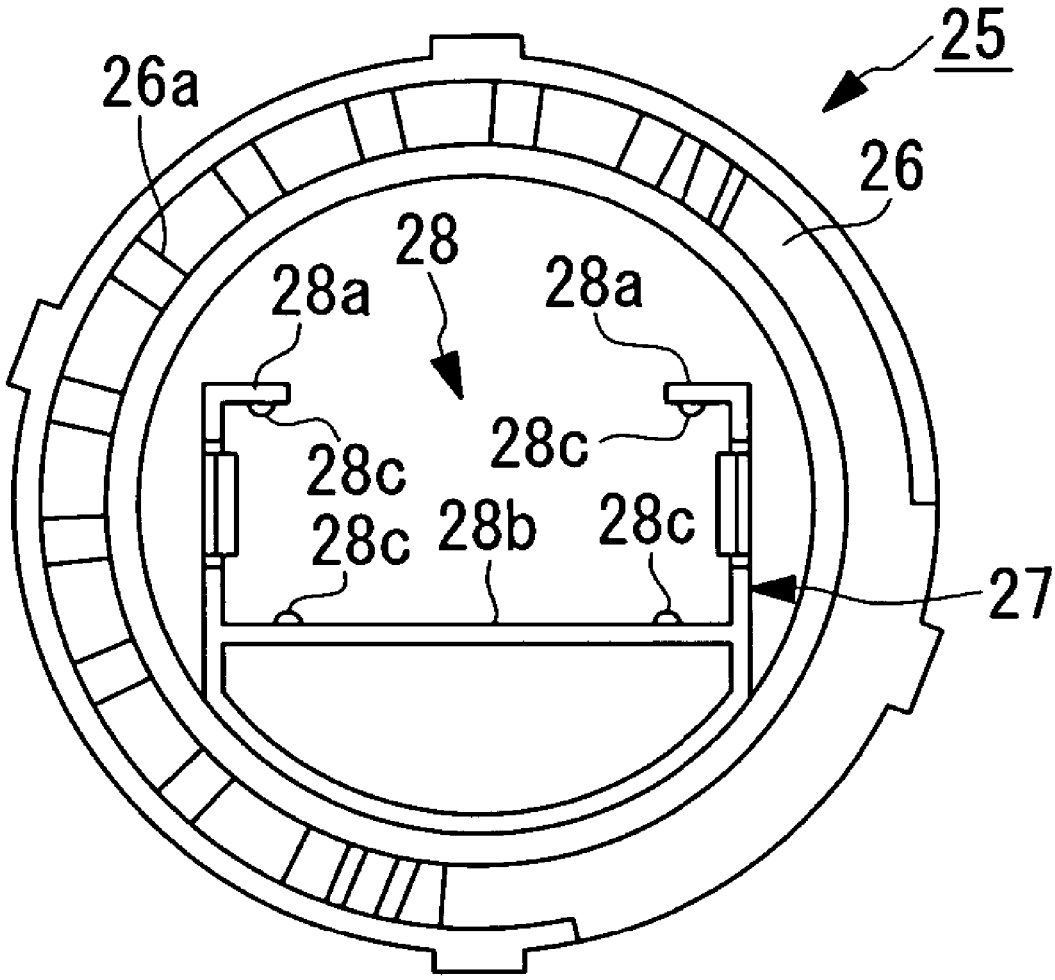
FIG. 3 is a front view showing a fixing bracket of FIG. 1.

An open portion 4 is provided in the chassis 3, in which the switch mechanism 10 is installed, and in a predetermined location of a circuit substrate 5 provided behind it, a push switch body 13, a dial switch body 22 (refer to FIG. 2), a temperature indicator 30, a light source 31 for night lighting, and a light source 33 (refer to FIG. 2) for an air conditioner on-off display panel 32 (refer to FIG. 4), are installed. Bulbs, LEDs, or the like, are used for the light sources 31 and 33.

The main member parts of the switch mechanism 10 are the above-mentioned push type switch part 11, and the dial knob 21, joint ring 23, rotary bracket 24, and fixing bracket 25 of the dial type switch 20, which are assembled such that they incorporate the push type switch part 11 in the center.

The push type switch part 11 comprises the push type switch body 13, which is supported in a predetermined position on the circuit substrate 5, and a knob case 14, which is provided with the pressure operating surface 12 on its operating surface (front surface) side, serving as a sliding part. The knob case 14 is a substantially cylindrical hollow member, which is retained in the fixing bracket 25 such that it can slide freely, and the pressure operating surface 12, on which necessary items such as the setting temperature and the like are displayed, is installed on one end face of the operating surface side. When the light source 31 emits light at night, the pressure operating surface 12 also becomes a lighting display whereby the display content can be seen clearly due to the lighting. Furthermore, an operating rod 15 projects from the rear end face of the knob case 14, which slides backwards and forwards engaged together with the knob case 14 to operate (turn on and off) the push switch body 13.

Pairs of right and left upper sliding surfaces 16 and lower sliding surfaces 17, which are supported in the fixing bracket 25 such that they can slide freely, are provided in the outer peripheral surface of the knob case 14, and concave groove parts 16*a* and 17*a*, which extend in the sliding direction (moving direction of the push type switch part 11 by the operation of the pressure operating surface 12) of the knob case 14, are formed in the sliding surfaces. In this case, the upper and lower sliding surfaces 16 and 17 are formed parallel to each other, becoming parallel end faces of the sliding part. Moreover, the concave groove parts 16*a* are formed in each of the right and left upper sliding surfaces 16, and the pair of concave groove parts 17*a* set a predetermined distance apart are formed in the lower sliding surface 17. Therefore, a total of four concave groove parts 16*a* and 17*a* are provided parallel to each other.

In order to guide the illumination light of the above-mentioned light source 33 directly to an on/off indicating lamp 32, a tubular light guide 18 is provided in the rear end face of the knob case 14. By providing such a light guide 18, it is possible to emit only the light of the on/off indicating lamp 32 without the illumination light leaking to the surroundings.

The dial knob 21 is a substantially cylindrical rotary operating member, in the center of which a cavity is provided for the knob case 14 of the push type switch part 11 to be installed. The knob case 14, which is inserted into the cavity of the dial knob 21 and installed in a predetermined location, is installed such that the pressure operating surface 12 covers the open portion on the operating surface side. However, the dial knob 21 and the push type switch part 11 are not connected to each other, and they can perform rotary or sliding switching operations freely.

The dial knob 21 is connected with the joint ring 23 supported by the front panel 6 provided as an operating surface substrate such that it rotates freely, and they rotate together. The front panel 6 is a member that is installed on the operating surface side of the air conditioner panel, and is joined with the chassis 3. The joint ring 23 is a ring-shaped member, which is supported in the open portion 7 of the front panel 6 via hooks 23*a* such that it rotates freely. Here, the dial knob 21 and the joint ring 23 are connected and fastened together by the engagement of the hooks 21*a*, so that both members rotate together.

The joint ring 23, which rotates together with the dial knob 21, is also joined with the rotary bracket 24 serving as a rotary bracket member. The rotary bracket 24 comprises a ring-shaped member 24*a* being a substrate, a switch rotation shaft 24*b* which is joined with the drive shaft of the dial switch body 22, and an arm 24*c* which connects the ring-shaped member 24*a* to the switch rotation shaft 24*b*, forming the rotary bracket 24 as an integrated part.

A tubular tapered part 24*d* is provided on the ring-shaped member 24*a* of the rotary bracket 24 between the joint ring 23 and the rotary bracket 24, and the tubular tapered part 24*d* is fitted into the joint ring 23 to support it. In this case, since the diameter of the inclined surface of the tubular tapered part 24*d* is smaller towards the tip end on the operating surface side, the tapered shape makes it possible to control the location of the rotary bracket 24 in the circumference direction and its location in the height direction.

The combined part of the joint ring 23 and the rotary bracket 24 is constructed such that a rib 24*e*, being a convex part provided in the rotary bracket 24, and a notch 23*b*, being a concave part provided in the joint ring 23, are engaged at a predetermined position. The engagement of the rib 24*e* and the notch 23*b* ensures that the turning force is transmitted between the two parts of the joint ring 23 and the rotary bracket 24, and controls the mating location between the two parts in the circumference direction.

In this case, regarding the engagement of the rib 24*e* and the notch 23*b*, it is preferable to provide a mating location adjustment in the radial direction by setting the dimensions loosely in the radial direction. With such a location adjustment provided, even if there is a slight shift in the central positions between the joint ring 23 and the rotary bracket 24, the offset is absorbed, so that they can be assembled easily.

As a result, the arm 24*c* functions as a turning force transmission member that connects the ring-shaped member 24*a* and the switch rotation shaft 24*b*, which is positioned on the center axis, to transmit the turning force. Therefore, since the turning force generated by operating the dial knob 21 is transmitted to the ring-shaped member 24*a* of the rotary bracket 24 via the joint ring 23, and furthermore is transmitted to the switch rotation shaft 24*b* via the arm 24*c*, the switching operation of the dial switch body 22 can be performed directly by the rotation of the dial knob 21.

The range (angle) over which a switching operation is possible by rotating the dial knob 21 is limited by the arm 24*c* interfering with the operating rod 15 and the light passage 18, for example. Therefore, it is not possible to operate the dial knob 21 through a full 360° circle. Accordingly, although the operation of the dial knob 21 differs depending on a range of conditions, it may be set such that it is possible within a range of approximately 220°.

At the other side, the fixing bracket 25 is installed in the open portion 4 of the chassis 3 as a ring-shaped support member. The fixing bracket 25 has a substantially U shaped support part 27 provided in the ring-shaped member 26.

The ring-shaped member 26 is fixed to and supported by the open portion 4, and a corrugated surface 26*a*, which varies in the circumference direction, is formed on the end face, being the operating surface side. That is, the corrugated surface 26*a* is formed on the front side of the ring-shaped member 26, being the base material of the fixing bracket 25, in order to afford a sense of regulation to the rotary operation of the dial knob 21.

The retaining part 27 is a part that is provided with a guide part 28, which retains the knob case 14 of the push type switch part 11 in a predetermined position, and also supports it such that it can slide freely. The retaining part 27 has a U shaped bottom part area connected to the ring-shaped member 26, and is provided with a pair of right and left bent-in end faces 28*a* that bend inwardly at the two end parts of the U shape. The bent-in end faces 28*a* form the guide part 28 which provides support between the upper and lower sliding surfaces 16 and 17 of the knob case 14 such that they can slide freely. The length of the guide part 28 and the parallel end faces (upper sliding surface 16 and lower sliding surface 17) of the knob case 14 determines the position with respect to the shaft center that the knob case 14 slides in a switching operation.

Furthermore, the bent-in end faces 28*a* and the bottom part supporting face 28*b* are provided with convex parts 28*c* which engage with the concave groove parts 16*a* and 17*a* on the upper and lower sliding surfaces 16 and 17 sides to form a guide-rail mechanism. By providing such a guide-rail mechanism, when the push type switch part 11 is pressed, the knob case 14 can be guided backwards and forwards accurately, thus enabling it to slide smoothly without shaking.

For a mechanism that affords the dial switching operation a sense of regulation by the corrugated surface 26*a*, as shown in FIG. 7 for example, the rotary bracket 24 is provided with a tubular guide part 29*a* which opens toward the corrugated surface 26*a*, and a bearing 29*c* is installed in the tubular guide part 29*a* as a spherical member that is subjected to an urging force from an elastic material such as a coiled spring 29*b* or the like toward the corrugated surface 26*a*. Using such a construction, by the rotary bracket 24 rotating together with the operation of the dial knob 21, the bearing 29*c* rides over the corrugated surface 26*a* as it moves. As a result, a sense of resistance occurs in the dial operation accompanying the elastic deformation of the coiled spring 29*b* according to the shape of the corrugated surface 26*a*, so that it is possible to obtain a sense of regulation suitable to the operation of the dial knob 21.

In the switch mechanism 10 with the above construction, since there is the arm 24*c* between the light source 31 and the pressure operating surface 12, when the light source 31 is turned on, a shadow of the arm 24*c* is formed on the pressure operating surface 12. The formation of such a shadow makes it difficult to see the display content on the pressure operating surface 12, which is not desirable from the viewpoint of the product.

Therefore, in order to prevent the shadow from being formed, a shadow prevention part is installed, which reduces or removes the shadow of the arm 24*c* formed on the front surface of the push type switch part 10 by the light source 31. A first specific example of the shadow prevention part is that the arm 24*c*, at least, is made from a transparent or white resin. As a result, by the illumination light of the light source 31 passing through the arm 24*c* made from transparent resin, the arm 24*c* does not cast a shadow. Furthermore, by the illumination light of the light source 31 passing through the arm 24*c* formed from a white resin, the illumination light is dispersed by the white resin, making the shadow of the arm 24*c* fuzzy. Here, the reduction of the shadow means that the contrast of the shadow becomes fuzzy.

A second specific example of the shadow prevention part is that a plurality of light sources 31 is positioned in separated locations. As a result, the illumination lights are radiated from the light sources 31 in a plurality of directions, making the formation of the shadow fuzzy.

A third specific example of the shadow prevention part is that a light diffusing member such as frosted glass or the like is used. The light diffusing member is installed such that it blocks the passage of the illumination light which reaches the inner face side of the pressure operating surface 12 from the light source 31, for example an illumination passage 14*a* which opens to the rear end face of the knob case 14. As a result, the illumination light radiated from the light source 31 is diffused by passing through the light diffusing member, and then reaches the pressure operating surface 12, thus making the shadow of the arm 24*c* fuzzy.

As described above, in the dial type switch mechanism according to the present invention, since switching operations of the dial type switch mechanism 10 are performed by the joint ring 23, the rotary bracket 24, and the dial switch body 22, which are positioned so as to overlap on the same flat surface as the dial knob 21 as seen from the operating surface side, rotating together, it is possible to operate the push type switch part 11 and the dial type switch 20 independently, and also the installation space may be reduced. In other words, the dial type switch mechanism 10 is constructed such that switching operations of the dial type switch 20 are performed by the joint ring 23, the rotary bracket 24, and the dial switch body 22, which are positioned on the same axis as the dial knob 21, rotating together, and furthermore, the push type switch part 11 is retained such that it can slide freely along the guide part 28 of the fixing bracket 25 so that independent switching operations are possible regardless the operation of the dial type switch 20. Therefore, it is possible to reduce the flat surface installation space compared with a conventional construction using two shafts, in which gears are used. Accordingly, usage of this switch mechanism not only enables miniaturization of the air conditioner control panel, but also reduces restrictions to the positioning of the switches. Therefore, it is possible to increase the degree of freedom in the design of the air conditioner control panel.

Moreover, in the dial type switch mechanism according to the present invention, since the rotating structure of the switch mechanism is positioned coaxially, it is not necessary to locate a rotation detection mechanism for detecting the rotation state, such as gears, outside of the rotary operating member as in the conventional type. Accordingly, since the space requirement of the switch mechanism with respect to the plane direction is controlled by the external shape of the rotary operating member, the efficiency of space usage increases. As a result, if the installation space to be ensured is the same, it is also possible to enlarge the dial knob 21 to improve the operability, so that the degree of freedom in the design can be increased from a number of viewpoints.

If it is possible to enlarge the dial knob 21, it is also possible to increase the area of the pressure operating surface 12 of the push type switch part 21. Therefore, in addition to improving the operability, it is possible to display the legend of the pressure operating surface 12 using large characters and designs, and also to add more to the legend.

The present invention is not limited to the above embodiments, and it is possible to modify it as required within a range that does not depart from the scope of the present invention. For example, regarding the push type switch part contained inside the dial type switch part, a plurality of structures similar to the substantially U shaped retaining part may be provided, and also a plurality of pressure operating surfaces provided, such that each retains one of the sliding parts in a way that it can slide. Furthermore, regarding the guide-rail mechanism, the construction may be such that the concave groove parts 16*a* and 17*a* are not provided, and that only the convex part 28*c* is used for support.

Moreover, it is also possible to integrate the dial knob 21 and the joint ring 23 to reduce the number of parts.

INDUSTRIAL APPLICABILITY

The dial type switch mechanism according to the present invention is applicable to the control panels of a range of devices using a switch mechanism with a structure incorporating an integrated push type switch and dial type switch, in addition to the air conditioner control panel of a vehicle air conditioner.

The invention claimed is:

1. A dial type switch mechanism furnished with at least one push type switch part provided in a center, and a dial switch part which operates a dial fitted around said at least one push type switch part, wherein there are provided:

a substantially cylindrical rotary operating member, in a center of which a cavity is provided for said at least one push type switch part to be installed;

a ring-shaped connecting member, which is supported such that said connecting member can rotate freely relative to an operating surface substrate, and connects and rotates together with said rotary operating member; and a rotary bracket member, which is joined to said connecting member, and in which a switch rotation shaft that operates said dial type switch part is connected together with a ring-shaped member via a turning force transmission member.

2. A dial type switch mechanism according to claim 1, wherein in the connection of said connecting member and said rotary bracket member, a turning force is transmitted by engagement of a convex part provided in said connecting member and a concave part provided in said rotary bracket member.

3. A dial type switch mechanism according to claim 2, wherein in the engagement of said convex part and said concave part, a mating location adjustment is provided in a radial direction.

4. A dial type switch mechanism according to claim 1, wherein a sliding part of said push type switch is installed in a ring-shaped support member having a substantially U shaped retaining part, which is fixed to and supported by a switch mechanism body substrate, and is retained in a guide part which supports parallel end faces provided in said sliding part such that they can slide freely.

5. A dial type switch mechanism according to claim 4, wherein a sliding surface part which supports said parallel end faces by said guide part is provided with a guide-rail mechanism in which a convex part and a concave groove part are engaged.

6. A dial type switch mechanism according to claim 4, wherein a corrugated surface, which varies in a circumference direction, is formed on an end face of an operating surface side of said support member, facing said rotary bracket member, and also a rotatable spherical member, which is subjected to an urging force from an elastic material in a direction towards said corrugated surface with which the spherical member makes contact, is provided in an end face of an operating surface side of said rotary bracket and is supported such that the spherical member can move in the direction of the urging force.

7. A dial type switch mechanism according to claim 1, wherein a shadow prevention part is installed, which reduces or removes a shadow of said turning force transmission member formed on a front surface of said push type switch by a light source.

* * * * *